US010865507B2

(12) United States Patent
Magnusson

(10) Patent No.: US 10,865,507 B2
(45) Date of Patent: Dec. 15, 2020

(54) WASHING MACHINE WITH DRAWERS AND FLEXIBLE WASHING COMPARTMENT

(71) Applicant: Roderinno AB, Nacka Strand (SE)

(72) Inventor: Fredrik Magnusson, Saltsjö-boo (SE)

(73) Assignee: Roderinno AB, Nacka Strand (SE)

( * ) Notice: Subject to any disclaimer, the term of this patent is extended or adjusted under 35 U.S.C. 154(b) by 172 days.

(21) Appl. No.: 16/087,187

(22) PCT Filed: Feb. 15, 2017

(86) PCT No.: PCT/SE2017/050144
§ 371 (c)(1),
(2) Date: Sep. 21, 2018

(87) PCT Pub. No.: WO2017/164790
PCT Pub. Date: Sep. 28, 2017

(65) Prior Publication Data

US 2019/0100863 A1 Apr. 4, 2019

(30) Foreign Application Priority Data

Mar. 23, 2016 (SE) ..... 1650391

(51) Int. Cl.
*D06F 15/02* (2006.01)
*D06F 35/00* (2006.01)
(Continued)

(52) U.S. Cl.
CPC ..... *D06F 15/02* (2013.01); *D06F 35/002* (2013.01); *D06F 35/006* (2013.01);
(Continued)

(58) Field of Classification Search
CPC ..... D06F 15/02; D06F 18/00; D06F 29/005; D06F 17/02; D06F 13/00; D06F 13/06;
(Continued)

(56) References Cited

U.S. PATENT DOCUMENTS 2,570,529 A 10/1951 Ja Dolan
2,596,791 A 5/1952 Rand
(Continued)

FOREIGN PATENT DOCUMENTS

CN 1570250 A 1/2005
CN 101617077 A 12/2009
(Continued)

OTHER PUBLICATIONS

Extended European Search Report for corresponding European Patent Application No. 17770703.1 dated Aug. 2, 2019.
(Continued)

*Primary Examiner* — Jason Y Ko
*Assistant Examiner* — Omair Chaudhri
(74) *Attorney, Agent, or Firm* — Renner, Otto, Boisselle & Sklar, LLP

(57) ABSTRACT

Washing machine (1) for the washing of laundry such as clothes and textiles, which washing machine comprises a housing, open frame (1*a*), wherein the housing (1*a*) comprises: an inlet (4), for supplying washing water, an outlet (5), for disposal of washing water, a pump (6), for pumping the washing water and air, that the housing (1*a*) comprises at least one, preferably a plurality of washing drawers (2), each washing drawer (2) having a pair of conduits (4*a*, 5*a*) for fluid tight connection of a respective flexible washing compartment (10) for washing laundry and arranged in the washing drawer (2)), wherein each drawer (2) of the housing (1*a*) is arranged to lead water from the inlet (4) of the housing (1*a*) via conduit (4*a*) to the respective washing compartment (10) arranged therein and, by means of the pump (6) and conduit (5*a*), to pump air and water out from the respective flexible washing compartment (10) in order to create a pressure difference inside the washing compartment (10) with respect to the surrounding pressure and by that
(Continued)

Figure 1A:
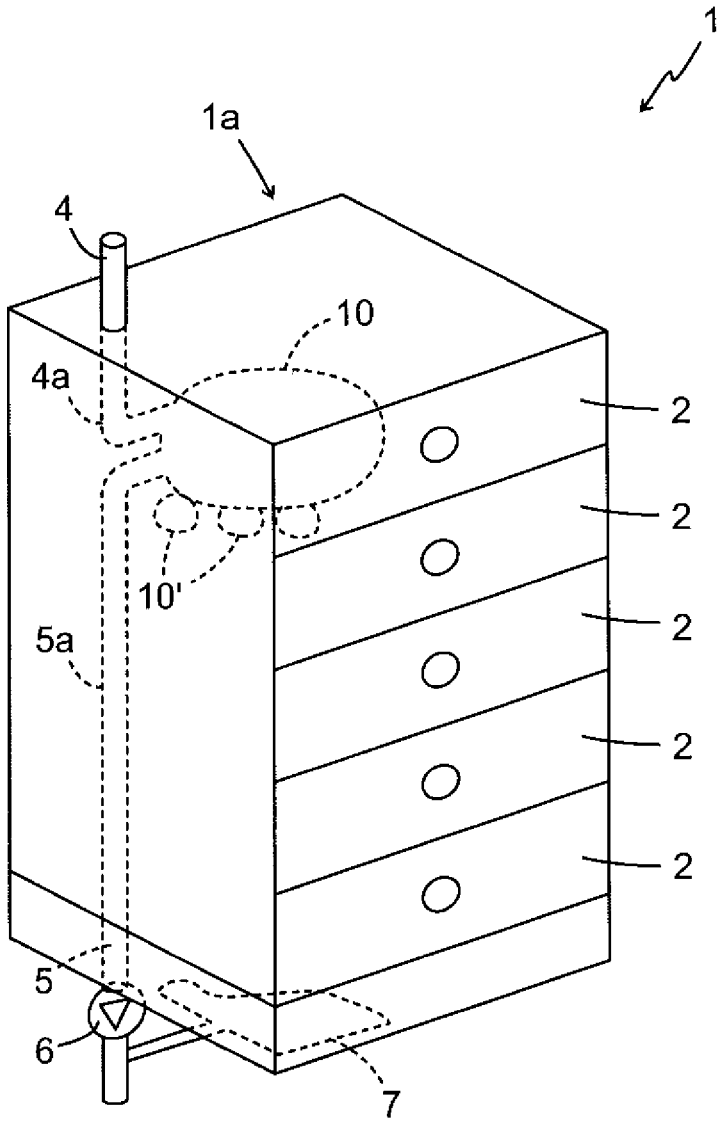

emptying the flexible washing compartment (10) of washing water and air, wherein one or more inflatable outer compartment(s) 10' is/are arranged to provide pressure on the outside of the washing compartment 10.

6 Claims, 6 Drawing Sheets

(51) Int. Cl.
*D06F 39/08* (2006.01)
*D06F 39/12* (2006.01)
*D06F 18/00* (2006.01)
*D06F 17/02* (2006.01)

(52) U.S. Cl.
CPC ..... *D06F 39/088* (2013.01); *D06F 17/02* (2013.01); *D06F 18/00* (2013.01); *D06F 39/083* (2013.01); *D06F 39/12* (2013.01)

(58) Field of Classification Search
CPC ..... D06F 15/00; D06F 39/12; D06F 31/00; D06F 19/00; D06F 13/04; D06F 58/00–52; D06F 59/00–08; D06F 39/006
See application file for complete search history.

(56) References Cited

U.S. PATENT DOCUMENTS 6,219,871 B1 * 4/2001 Frederick ..... D06F 17/02 68/183
2007/0151120 A1 7/2007 Tomasi et al.
2009/0145176 A1 * 6/2009 Kim ..... D06F 31/00 68/27
2012/0090360 A1 * 4/2012 Nolan ..... D06F 39/083 68/12.19
2012/0234054 A1 9/2012 Kim et al.
2013/0205513 A1 * 8/2013 Magnusson ..... D06F 1/00 8/137
2016/0258097 A1 * 9/2016 Hake ..... D06F 21/08
2019/0085493 A1 * 3/2019 Magnusson ..... D06F 39/083

FOREIGN PATENT DOCUMENTS

CN 103290647 A 9/2013
FR 1 192 471 A 10/1959
JP S51111772 A 10/1976
JP S52-94660 A 8/1997
RU 2018555 C1 8/1994
WO 2006/010970 A1 2/2006
WO WO 2009072765 A2 6/2009
WO WO 2012057688 A1 5/2012

OTHER PUBLICATIONS

International Search Report and Written Opinion for corresponding Patent Application No. PCT/SE2017/050144 dated Apr. 21, 2017.
Chinese Office Action for corresponding Chinese Patent Application No. 2020042301859890 dated Apr. 27, 2020.

* cited by examiner

WASHING MACHINE WITH DRAWERS AND FLEXIBLE WASHING COMPARTMENT

FIELD OF THE INVENTION

The invention relates to a washing machine and in particular to a washing machine in which the laundry is washed inside an especially adapted flexible washing device that is arranged in a fluid tight manner on the washing machine.

BACKGROUND OF THE INVENTION

Conventional washing machines of today are usually relatively voluminous, usually of a certain standard measure. A washing machine washes laundry, such as clothes, by wetting them, de-moisturing them, wetting them again etc. until the laundry is clean. In order to accomplish this laundering most of today's washing machines comprise a cylindrical drum in which the laundry may be alternately soaked and dried without having to be transferred between different chambers. The latest development in the laundry business has apart from the development of advanced washing programs and informative user interfaces been all about minimization of the consumption of energy and water, and to some extent the drying effect, whereby the washing machines of today are both more energy efficient and consume less water than what was the case only 10 years ago. Further, the spin-drying efficiency has been increased such that the washed laundry will be drier than what has been possible in the past. This is advantageous since it implies that less energy needs to be consumed at the subsequent drying of the laundry. On the other hand the washing machines are just as voluminous as they were 50 years ago and no significant solution to the problem with wear and tear of laundry has been presented.

PRIOR ART

A washing machine is disclosed in U.S. Pat. No. 2,596,791. In this washing machine the laundry is washed in a washing space that is delimited by a membrane of a washing compartment. The laundry is pressed by means of the surrounding outer pressure by reducing pressure inside the washing compartment. A combined inlet and outlet can be arranged in the lowest part of the washing compartment. A separate washing device comprising e.g. water supply and a pump is separately arranged to be connected to the inlet and outlet on the washing compartment where it is has been hung.

A washing machine is described in EP-B1-2 633 113.

SUMMARY OF THE INVENTION

An object of the invention is to provide a washing machine that is not limited to a certain size as conventional washing machines that wash laundry in a satisfying manner without the use of hand power and that is uncomplicated to mount and to connect for washing purposes.

The invention relates to a washing machine that comprises a housing, or an open frame, and having an inlet and outlet for water, and at least one pump. In contrast to conventional washing machines having rotating perforated metal drums, the laundry is washed in at least one, or a plurality of flexible washing compartments arranged stacked onto each other, or side-to-side to each other, inside the housing, or the frame, of the washing machine. The flexible washing compartment(s) typically comprises one flexible and a hard plate, or alternatively two flexible membranes together making up a washing compartment, or is provided as a washing compartment. The plurality of flexible washing compartments is provided adjacent to each other, for instance in a plurality of drawers. The flexible washing compartment(s) is/are each provided in the drawer(s) by means of a respective suitable fluid tight connection for inlet and outlet of water and air. Subsequently, water is provided into the flexible washing compartment from the washing machine, which is heated to the desired temperature. A washing detergent may be provided directly to the washing compartment or via a separate compartment in the washing machine to be distributed into the washing compartment together with the water. After that the water has been added to the washing compartment the pump is activated. Firstly the pump is used to suck air from the washing compartment to reduce the volume of the washing compartment, whereby the laundry is compressed and soaked in water. Gradually the water is sucked out, and the same water may be returned for instance via a filter to a reservoir provided in the washing machine to the washing compartment a couple of times before the water is exchanged and the cycle is repeated once again.

The washing compartment(s) is/are subject to receive over-pressure on its outside to further increase washing. This is provided by means of one or more inflatable outer compartment(s) arranged to provide pressure on the outside of the washing compartment.

In this way, the under-pressure inside the washing compartment is assisted when washing the laundry inside the washing compartment. The laundry is splashed, kneaded, moved, pushed and mangled. This can be provided simultaneously or in a specific pattern and thereby assist the vacuum to centrifuge the laundry. It is also possible to press the laundry hence and forth.

According to an embodiment, the inflatable outer compartment is a balloon. According to an embodiment, the inflatable outer compartment is a bladder. Herein, this disclosure, the term "washing compartment" can be regarded as meaning and hence being any washing cavity.

Specifically, the invention relates to a washing machine for the washing of laundry such as clothes and textiles. An advantage of the invention as a result of the pressure difference induced pre-compression of the textiles is that only as much, typically an absolute minimum of water as is needed to wet the laundry is required whereby the consumption of both water and energy may be minimized. Another advantage is that a several different types of laundries can be washed at the same time in the different drawers.

A further advantage is that the washing machine may be arranged on a wall horizontally (drawers side-by-side) or vertically (stacked drawers).

Further advantages of the invention will be apparent from the detailed description and the dependent claims.

SHORT DESCRIPTION OF THE DRAWINGS

Figure 1B:
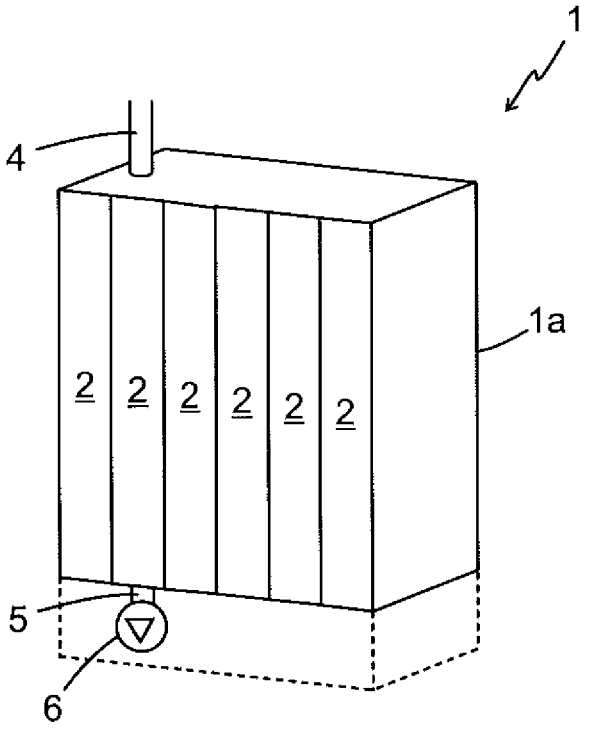
Figure 1C:
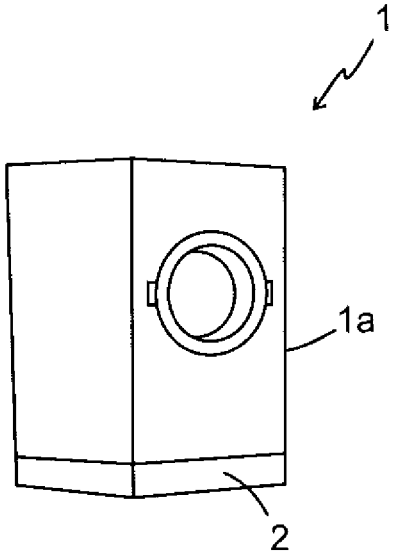
Figure 2A:
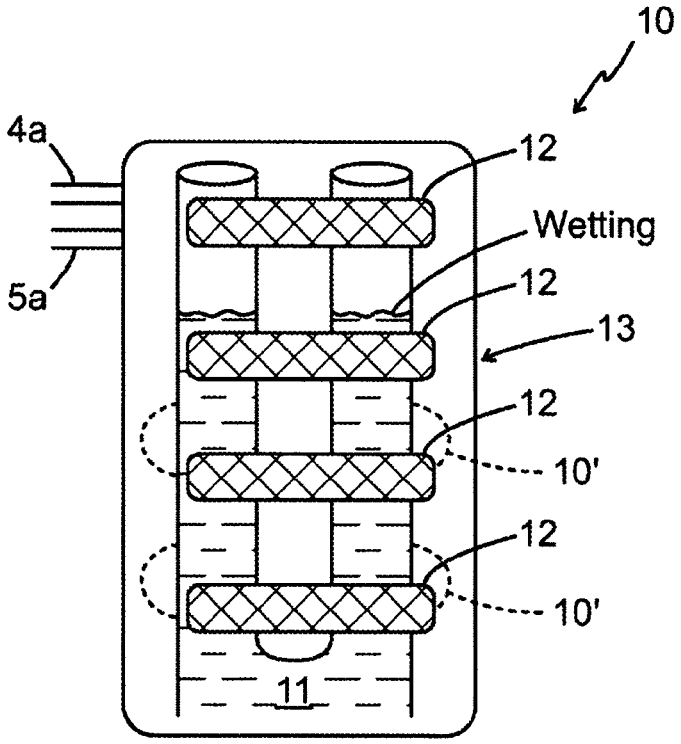

FIG. 1*a* shows, in a perspective view, an embodiment of a washing machine comprising a housing with a plurality of washing drawers, FIG. 1*b* shows yet an alternative embodiment of a washing machine having a plurality of drawers arranged side-by-side, and FIG. 1*c* shows an alternative embodiment of a washing machine comprising one drawer combined with a conventional washing machine having a perforated metal washing drum, FIG. 2*a* shows a washing compartment embodied as a flexible bag 10 having a means 13 for opening and closing the washing compartment.

Figure 2B:
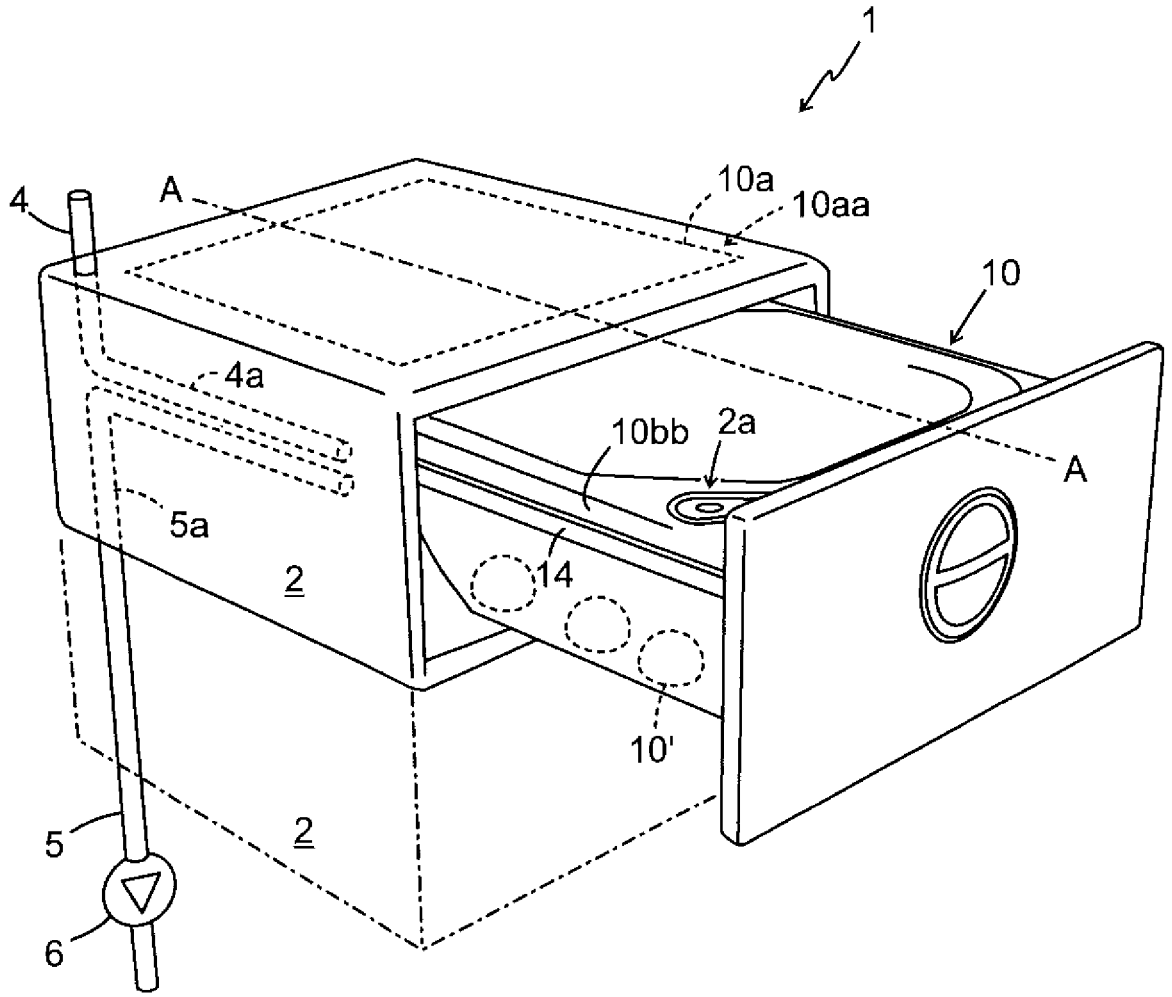

FIG. 2*b* shows, in a perspective view, a washing drawer, having a washing compartment of membrane type, and three inflatable outer washing compartments.

Figure 2C:
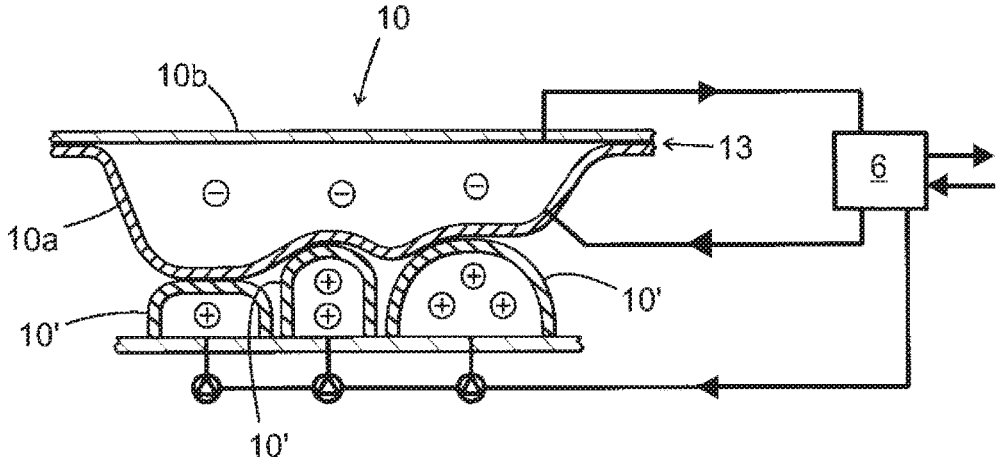

FIG. 2*c* shows, in a cross-sectional view, a washing drawer, having a washing compartment of membrane type, and three inflatable outer washing compartments being more or less inflated to provide positive pressure.

Figure 3A:
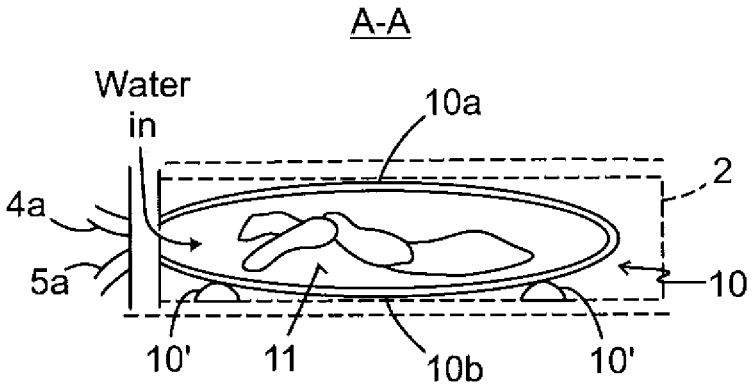
Figure 3B:
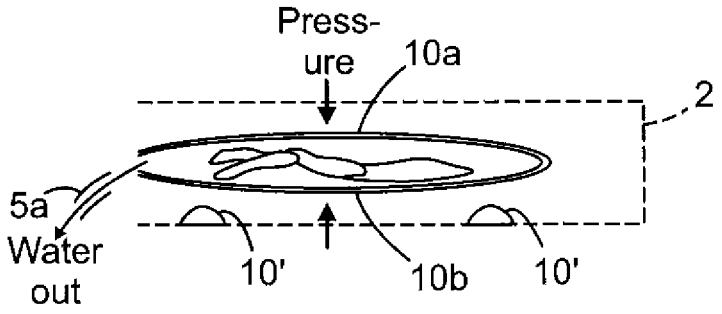

FIG. 3*a* shows a flat washing compartment filled with laundry, herein a pair of trousers, FIG. 3*b-c* respectively shows a cross-sectional view along line A-A of the washing drawer in FIG. 2*b*, showing the washing compartment made of membranes and containing laundry, and FIG. 3*c* shows inflating the inflatable outer washing compartments (pressure indicated by arrows only) according to an embodiment.

DETAILED DESCRIPTION OF EMBODIMENTS

A first embodiment of the washing machine according the invention is shown in FIG. 1*a*. In this figure, the components of the washing machine are only schematically shown, but will be shown in more detail in FIGS. 2-3. The washing machine 1 is suitable for the washing of several types of laundry such as clothes and textiles at the same time or in any desired manner. The washing compartment(s) is/are subject to receive pressure, typically over-pressure, or positive pressure on its outside to further increase washing. This is provided by means of one or more inflatable outer compartment(s) arranged to provide pressure on the outside of the washing compartment. The washing compartment 10 is subject to receive pressure on its outside to further increase washing. The washing compartment(s) is/are subject to receive over-pressure on its outside to further increase washing.

FIG. 1*a* shows, in a perspective view, an embodiment of a washing machine comprising a housing with a plurality of washing drawers, wherein the washing compartment(s) 10 is/are subject to receive pressure on its outside to further increase washing. This is provided by means of one or more inflatable outer compartment(s) (only schematically shown in this FIG. 1*a*) arranged to provide pressure on the outside of the washing compartment 10. FIG. 1*b* shows yet an alternative embodiment of a washing machine having a plurality of drawers arranged side-by-side. FIG. 1*c* shows an alternative embodiment of a washing machine comprising one drawer combined with a conventional washing machine having a perforated metal washing drum. The housing may alternatively be embodied as a frame, which can be an open frame, in all embodiments without departing from the invention.

Now is referred to FIG. 1*a*.

The washing machine shown in FIG. 1*a* comprises a housing 1*a*. The housing 1*a* comprises a plurality of washing drawers 2 provided as a set of washing drawers 2 stacked onto each other in the housing 1*a*, each drawer 2 comprising a respective flexible washing compartment such as a washing compartment having a water and air-tight openable seal, or comprising a pair of flexible membranes (not shown in FIG. 1*a*), for washing laundry and arranged in the washing drawer 2. Alternatively, a hard openable frame having a water- and/or air-tight seal can be provided instead of the water and air-tight openable seal. This is illustrated in FIG. 2.

The washing machine 1 comprises an inlet 4, for supplying clean washing water and an outlet 5, for disposal of used washing water. The washing machine 1 further comprises one or more pump(s) 6, in order to pump the used washing water out of the washing compartment. In order to supply clean water via the inlet 4 no pump is normally needed because the water will be provided from a pressurized and closed water system such as a public water supply system. Each washing compartment 10 in each drawer 2 is connected to a pair of conduits 4*a*, 5*a* arranged to lead water from the inlet 4 of the housing via a conduit 4*a* to the respective washing compartment 10 arranged in each drawer 2 and to lead air and water away from the washing compartment 10 via a conduit 5*a*, by means of the pump 6. The pair of conduits 4*a*, 5*a* from each washing compartment 10 in each drawer 2 can be combined into one inlet 4 and outlet 5 for all washing compartments 10. The conduit 5*a* may also be connected to a reservoir 7 (schematically shown) inside the washing machine 1 for receiving used washing water and re-circulating the washing water one or more times back to the washing compartment 10.

The pump 6 may is utilized to create a pressure difference between the washing compartment 10 and its surroundings (in the drawer 2), typically a negative pressure, normally referred to as vacuum in the washing compartment 10 and atmospheric pressure in the drawer 2.

The washing compartment(s) 10 is/are subject to receive pressure on its outside to further increase washing. This is provided by means of one or more inflatable outer compartment(s) (only schematically shown in this FIG. 1*a*) arranged to provide positive pressure on the outside of the washing compartment 10. Herein, the term "positive pressure" means positive in relation to the pressure inside the washing compartment.

The same pump 6 can be provided for providing negative pressure to the washing compartment, and positive pressure to the inflating outer compartments 10'.

Alternatively, to the embodiment shown in FIG. 1*a*, which comprises a plurality of drawers, it is possible to just have one drawer 2, potentially in combination with a conventional washing machine as shown in FIG. 1*c*, but not limited thereto.

Now is referred to FIG. 2*a*, which shows a washing compartment 10 embodied as a flexible bag having an openable and closable seal 13, or is alternatively arranged in an openable/closable air and water-tight frame (not shown), for opening and closing the washing compartment 10. The washing compartment may be made of any fluid-tight suitable material such as plastics and may be transparent such that a user easily can see if the washing compartment is empty or not. In FIG. 2*a*, the washing compartment is a flat transparent bag 10, shown filled with laundry 11, herein exemplified as a pair of trousers arranged in a flat manner. It is an advantage that the laundry may be arranged flat in that ironing can be avoided and some sensitive laundry may benefit from being washed flatly and without the laundry moving inside the washing compartment, thereby avoiding wearing of the laundry against the walls of the washing compartment as is typically the case in a conventional washing machine having a rotating perforated metal drum inside which the laundry wears against the drum. The washing compartment 10 is connected to a pair of conduits 4*a*, 5*a*, which are schematically shown only. Typically, the washing compartment is permanently fixed into the drawer and permanently connected to the conduits 4*a*, 5*a*. Islands 12 of material extending above a flat surface of the bag 10 and arranged to receive the laundry 11 provides that the water wets the laundry 11 and moves via the laundry 11 instead of moving beside the laundry 11 when the pump 6 is turned on. Patterns of the islands 12 as well as of inlets and outlets may vary/look different. According to aspect, but not limited thereto, this implies that the laundry is wetted in a longitudinal direction when the pump 6 is turned on. This is schematically marked as "wetting" in this FIG. 2*a*. The washing compartment(s) 10 is/are subject to receive pressure on its outside to further increase washing. This is provided by means of one or more inflatable outer compartment(s) 10' (only schematically shown in this FIG. 2*a*) arranged to provide pressure on the outside of the washing compartment 10.

This embodiment is suitable for avoiding ironing the laundry as is typically required after washing in conventional washing machines.

Now is referred to FIG. 2*b*, which shows, in a perspective view, a washing drawer 2 having a pair of conduits 4*a*, 5*a* 4*a*,5*a* for fluid tight connection of a respective flexible washing compartment 10 for washing laundry and being arranged in the washing drawer 2. The washing compartment 10 shown in this drawing comprise of two flexible membranes, herein an upper 10*a*, and a lower membrane (not shown), which can be opened or closed in a fluid-tight manner by moving the drawer 2 out from the housing 1*a* for opening, or into the housing 1*a* for closing the washing compartment 10. This can be achieved since, the membranes are mounted in a respective upper 10*aa*, and lower 10*bb* frame, of which the upper membrane 10*a* can be opened or closed. According to various embodiments, the washing compartment 10 may alternatively comprise one or more membranes, such as one flexible membrane provided on a rigid plate. The upper frame having the upper membrane 10*a* is arranged to be automatically opened when the drawer 2 is pulled out. This can be provided by having the frames 10*aa*, 10*bb* provided at a rail, wherein a pressure roll is arranged to press the upper frame 10*aa* having the upper membrane 10*a* against the lower frame 10*bb* having the lower membrane against each other when the drawer is pushed in and releasing the frames 10*aa*, 10*bb* to each other when the drawer is pulled out. Other mechanisms such as parallelograms, excenters, tracs, manual doors etc. providing opening or closing the washing compartment are obvious for the skilled person and the invention is by no means limited to this particular embodiment. The drawer 2 can be provided with a non-flexible lower tray 14, potentially suitable for preventing leakage, provided under the flexible membrane 10*b* (or in the embodiment in FIG. 2*a*, under the flexible bag), which may be provided with external inflatable outer compartments 10', 10', 10' for "assisting agitating" the laundry 11. This is schematically shown only in FIG. 2*b*.

Now is referred to FIG. 2*c*. FIG. 2*c* shows, in a cross-sectional view, a washing drawer, having a washing compartment of membrane type having a washing compartment 10 embodied as a flexible membrane 10*a* having a openable and closable rigid plate 10*b* provided with a seal 13, and three inflatable outer washing compartments 10'.

The external inflatable outer compartments 10' can be embodied as one or more inflatable bag(s) arranged externally to the washing compartment 10 for lifting up a part of the laundry positioned on inflatable bags 10'. The inflatable bags 10' operate such that when the pump 6 is switched on and creates a negative pressure inside the washing compartment 10, the laundry is also lifted up by means of the inflatable bags 10'. In this way, the under-pressure – inside the washing compartment 10 is assisted by the outer pressure + when washing the laundry inside the washing compartment. The laundry is splashed, kneaded, moved, pushed and mangled. This can be provided simultaneously or in a specific pattern and thereby assist the vacuum in centrifuging the laundry. It is also possible to press the laundry hence and forth.

The same pump 6 can be provided for providing negative pressure to the washing compartment, and positive pressure to the inflating outer compartments 10' as shown in FIG. 2*c*. This is not limited to this specific embodiment, but is applicable to all embodiments even if not specifically shown and/or described.

According to an embodiment, the inflatable outer compartment is a balloon.

According to an embodiment, the inflatable outer compartment is a bladder.

Now is referred to FIGS. 3*a* and 3*b*, which shows a cross-sectional view along line A-A of the washing drawer in FIG. 2*b*. FIG. 3*b* shows the washing compartment 10 made of membranes and containing laundry and comprising two membranes 10*a*, 10*b*.

In FIG. 3*a*, an embodiment of the flexible washing compartment 10 made up of two flexible membranes 10*a*, 10*b* is shown with laundry 11 inside. The two membranes 10*a*, 10*b* are arranged on a frame preventing the washing compartment 10 to restrict across and along the frame, but still providing flat compression due to the pressure difference between the pressure inside the flexible compartment 10 and its surroundings in the drawer 2, typically the pressure inside the flexible compartment 10 is atmospheric pressure before compression, wherein the inflatable bags 10' are not inflated, as shown in FIG. 3*a* and the pressure outside the flexible compartment after compression due to negative pressure inside the washing chamber and positive pressure outside the washing chamber 10 is positive pressure +, providing a pressure difference. Then the inflatable bags 10' are inflated. This is only schematically shown in FIG. 3*b*.

The washing machine may also include an additional drying unit in order to dry the laundry by the supply of dry hot air in the flexible washing compartment 10.

If the washing compartment is provided for heated air drying, one, or more, typically two fine-meshed nets are provided on top of and under the membranes 10*a*, 10*b*, respectively, but surrounding the inflatable. A drying unit (not shown) is provided for blowing dry, heated air through the nets for drying the laundry 11. Then, the flexible washing compartment 10 made of membranes 10*a*, 10*b* is inflated and by means of pressure elevated from the textiles letting the air flow freely around them.

The washing machine 1 according to various embodiments can operate as follows (See FIG. 1).

One or more of the flexible washing compartments 10 are opened and filled with laundry 11. Subsequently, water is provided via the inlet 4, and/or the conduit 4*a* to the flexible washing compartment(s) 10. The water is heated to a desired temp. The heating can be provided by means of a conventional heater (not shown) arranged inside or outside the washing machine 1. Then the air is sucked out of the flexible washing compartment, followed by the water being sucked out.

A washing detergent may be provided directly into the washing compartment or via a separate washing detergent compartment 2*a* provided centrally in the washing machine 1 or in the specific drawer 2 to be distributed into the washing compartment 10 together with the water. After that the water has been provided to the washing compartment, the pump 6 is activated. Firstly the pump 6 is used to suck air from the washing compartment, to minimize the volume that has to be wetted, whereby the laundry is compressed and soaked in water (See also FIG. 2*a*, where the wetting of the pair of trousers inside a washing compartment 10 having a zipper 13 is indicated schematically by the marking "wetting"). Gradually the water is sucked out, and the same water may be returned for instance via the reservoir 7 and filter(s) provided in the washing machine to the washing compartment a couple of times before the water is exchanged and the cycle is repeated once again.

An example of the operation of the invention according to various embodiments will now be given. First, the laundry 11 is placed in a washing compartment 10 of any of the types described above and in a drawer 2 of the washing machine 1. In the shown embodiment, the laundry 11 is placed in the washing compartment 10 inside the drawer 2. Then the washing compartment 10 is closed. After these measures, first air is sucked out, creating vacuum or under-pressure in the fibres and/or textiles of the laundry 11 then, clean washing water is supplied via inlet 4 to the washing compartment 10 replacing the under pressure, or vacuum and normalizing pressure and any air remaining in the washing compartment 10 is pumped out via the pump 6 such that the laundry 11 is soaked and compressed by the walls of the washing compartment 10. Once the laundry 11 is soaked it is possible to pump out the washing water from the washing compartment via the pump 6, wherein a certain negative pressure again is created in the washing compartment (See FIG. 3*b*), and wherein the laundry 11 is further compressed by the atmospheric pressure (or alternatively positive overpressure) outside the bag. The washing becomes efficient thanks to the combination of pressure towards the laundry and the movement of the washing water and air bubbles, which penetrate in between the fibers of the laundry and deeply remove impurities. Pressure differences acting on air bubbles influences the air bubbles to change in size, which implies that the air-bubbles on a micro-level "pumps" the water back and forth inside the fibers. Air is elastic contrary to water, such that water is transferred when the air bubbles grow or shrink. If a micro-bubble is stuck inside a hollow fiber, the fiber will pump clean inside the fiber. At the lowest pressure, the air bubbles are as large as possible. Further, the laundry may be kneaded by the walls of the washing compartment which increases the washing efficiency. Once the washing water has been recirculated via filter a number of times, the water sucked out to the desired degree, the rinsing water is supplied to the washing compartment. The purpose of the rinsing water is e.g. to perform a final cleaning of the laundry and to remove any remainders of the washing detergent. Further, rinsing fluid and/or fabric softener, which softens and/or gives the laundry a pleasant fragrance, may be supplied together with the rinsing water. The rinsing water is removed from the washing machine in the same manner as the washing water. Hence, any air that is left in the bag is pumped out such that the laundry is compressed and soaked, and subsequently the rinsing water is pumped out from the washing compartment, wherein a certain negative pressure is created in the washing compartment, and wherein the laundry is compressed by the atmospheric pressure outside of the washing compartment. Preferably, electronic equipment of the washing machine comprises a control with which it is possible to control the dryness of the laundry. The dryness may also be one of the parameters that are controlled by means of different washing programs, such that every washing programs is connected to a certain dryness, which naturally also may be the same for several different washing programs. The dryness is a function of the work of the pump and the created negative pressure inside the washing compartment. Hence, the max effect of the pump governs the maximal achievable dryness for a specific washing machine. The washing compartment may also be inflated by hot drying air as described above in relation to the embodiment shown in FIG. 3*c*. Before the washing compartment is opened air should be let in, in order to facilitate the opening of the bag.

Preferably, the washing machine 1 also comprises a heater unit with which the inlet water in inlet 4 may be heated to the desired temperature regardless of the inlet temperature.

The washing machine 1 could also include a small tank in which the heating unit may be arranged. The tank makes it possible to re-utilize the washing water. Due to environmental friendly reasons it is advantageous that the laundry is washed several times with the same water, because it saves both water and heating energy. Further, the washing efficiency is not drastically worsened because the same washing water can be used several times, since the washing water very rarely is saturated in impurities. Hence, a prewash with a first water change is only necessary when very dirty laundry is to be washed. A water exchange should however always be made for the rinsing of the laundry.

For reasons concerning both the environment and the washing efficiency it is also advantageous if the tank is heat isolated such that heat energy is saved between the different washing steps.

Preferably, the washing machine also comprises an electronic equipment (not shown) where a desired washing programme out of severable selectable washing programmes may be chosen. The washing programmes may e.g. control the washing temperature, number of soakings of the laundry, number of change of washing water, the dryness of the laundry after the performed washing and other parameters that may be controlled on conventional washing machines. Preferably, there is a number pre-set washing programmes that may be chosen by means of a suitable interface on housing 1*a*. To provide further flexibility or as a safety measure the interface of the electronic equipment may however be such arranged that the user is given information about which washing programme that is set to be used, whereby he may also have the possibility to change to another programme if desired.

As described, the housing 1*a* may also comprise a washing detergent compartment for dosage of washing detergent, which is located such that the water that is supplied to the washing compartment will pass and bring the washing detergent from it. It is however also possible to place the washing detergent directly inside the washing compartment, wherein no such compartment is needed in the main part, unless both a prewash and a main wash is desired, since the exchange of water that would result in that case would require the washing compartment to be opened between the prewash and the main wash in order to provide the washing detergent.

A washing compartment 10 that is to be used in the washing machine naturally needs to be specially designed in order for the washing to be performed in it. This is shown in FIGS. 2*a*, 2*b* and 3*a*-3*c*.

Parts of the inner walls of the washing compartment can be provided with fluid leading means such as concavities-and/or convexities in order for the walls not to get stuck towards each other without letting water and air pass when a negative pressure of a certain magnitude has been created inside the washing compartment.

In an alternative embodiment the concavities and/or convexities may be formed of at least one separate fluid permeable inner wall, e.g. in the form of a fine-meshed net, that extends along at least one of the inner walls and guarantees that the inner walls will not be stuck to each other.

It is advantageous if the walls do not have fluid leading means with sharp edges since these could damage the laundry and could undesirably assist to guide the fluid along the walls and not through the laundry. By creating islands of fluid leading surfaces surrounded by areas preventing fluid motion, the maximum flow of water through the laundry can be achieved. The washing effect is on the contrary achieved when the fluid flows through the laundry, preferably at the same time as they are kneaded by the walls as they are being sucked towards each other.

The washing compartment can also have a heat isolating layer in order to minimize the portion of heat energy that is emitted to the surrounding. This is important both for energy saving and wash efficiency reason.

The invention claimed is:

1. A washing machine for the washing of laundry, which washing machine comprises a housing, wherein the housing comprises:

an inlet, for supplying washing water, an outlet, for disposal of washing water, a pump, for pumping the washing water and air, that the housing comprises at least one washing drawer, each washing drawer having a pair of conduits for fluid tight connection of a respective flexible washing compartment for washing laundry and arranged in the washing drawer, wherein each washing drawer of the housing is arranged to lead water from the inlet of the housing via a first conduit of the pair of conduits to the respective flexible washing compartment arranged therein and, by means of the pump and a second conduit of the pair of conduits, to pump air and water out from the respective flexible washing compartment in order to create a pressure difference inside the flexible washing compartment with respect to the surrounding pressure and by that emptying the flexible washing compartment of washing water and air, wherein at least two inflatable outer compartment are arranged to provide pressure on the outside of the flexible washing compartment, the at least two inflatable outer compartments being configured to operate in conjunction with the pump so as to lift up laundry positioned on the at least two inflatable outer compartments when the pump is switched on.

2. The washing machine according to claim 1, wherein at least one of the inflatable outer compartments is a balloon.

3. The washing machine according to claim 2, wherein at least one of the inflatable outer compartments is a bladder.

4. The washing machine according to claim 1, wherein the flexible washing compartment is a flexible bag having an openable and closable seal for opening or closing the washing compartment.

5. The washing machine according to claim 1, wherein the pair of conduits from each washing compartment in each drawer can be combined into one inlet and outlet for all washing compartments.

6. The washing machine according to claim 1, wherein the conduits are connected to a reservoir inside the washing machine for receiving the washing water that has been used and re-circulating the washing water that has been used one or more times back to the washing compartment.

* * * * *